US006220919B1

(12) United States Patent
Cheng

(10) Patent No.: US 6,220,919 B1
(45) Date of Patent: Apr. 24, 2001

(54) ASSEMBLED BUILDING BLOCK FOR FORMING VARIOUS GEOMETRICAL SHAPES WITH CORNERS HAVING ANGLES 60 DEGREES, 90 DEGREES AND 120 DEGREES

(76) Inventor: Ming-Hsien Cheng, P.O. Box 82-144, Taipei (TW)

( * ) Notice: Subject to any disclaimer, the term of this patent is extended or adjusted under 35 U.S.C. 154(b) by 0 days.

(21) Appl. No.: 09/411,860

(22) Filed: Oct. 4, 1999

(51) Int. Cl.[7] ..... A63H 33/04; A63H 33/10

(52) U.S. Cl. ..... 446/117; 446/118; 273/156; 273/153 P

(58) Field of Search ..... 446/69, 85, 117, 446/118; 52/DIG. 10; 273/153 R, 156, 157 R, 153 P

(56) References Cited

U.S. PATENT DOCUMENTS

| | | | | |
|---|---|---|---|---|
| 490,679 | * | 1/1893 | Thurston | 273/156 |
| 1,660,119 | * | 2/1928 | Decker | 446/69 |
| 1,725,911 | * | 8/1929 | Graham | 446/118 |
| 2,151,030 | * | 3/1939 | Hinsen | 52/DIG. 10 X |
| 4,133,538 | * | 1/1979 | Ambrose | 273/157 R X |
| 4,325,552 | * | 4/1982 | Glasheen | 273/153 P |
| 4,597,579 | * | 7/1986 | Walton | 273/156 |
| 4,629,192 | * | 12/1986 | Nichols | 446/118 X |
| 4,699,602 | * | 10/1987 | Giorgi | 446/85 X |
| 4,964,833 | * | 10/1990 | Suzuki | 446/118 |
| 4,988,103 | * | 1/1991 | Cheng | 273/157 R |
| 5,702,105 | * | 12/1997 | Glikmann | 273/156 X |
| 5,711,524 | * | 1/1998 | Bauer et al. | 273/157 R |

* cited by examiner

*Primary Examiner*—D. Neal Muir
(74) *Attorney, Agent, or Firm*—A&J

(57) ABSTRACT

An assembled building block formed by nineteen unit assemblies and a plurality of round holes for forming various geometrical shapes with corners of angles 60 degrees, 90 degrees and 120 degrees. The unit assemblies are formed by 1 and 3 to 6 small units integrally, there are five combination and nineteen sub-combination in the assembling of each unit assembly. The small unit of the unit assemblies is a polygon, and 9~83 grooves for receiving the small units are formed on the surface of the building block seat. By the unit assemblies 1~19 to conform to different building block seats, many different assemblies are formed. Moreover, different shapes, such a plane single layers, or a stacked double layers, or a stacked three layers, or pyramids with three to five layers can be formed with the present invention. By the present invention, the plane arrangement can be converted into three dimensional assembly and many easy and difficult assembling ways are provided by the present invention for users of different ages.

2 Claims, 18 Drawing Sheets

ASSEMBLED BUILDING BLOCK FOR FORMING VARIOUS GEOMETRICAL SHAPES WITH CORNERS HAVING ANGLES 60 DEGREES, 90 DEGREES AND 120 DEGREES

BACKGROUND OF THE INVENTION

The prior art games, such as 'assembling pattern' and 'seven pieces puzzle' only have one playing way. Although many other games may change ways for playing, thus playing way only limits in a plane without any variations of three dimensions. Therefore, there is an eager demand for a novel game device which has many playing ways in two or three dimensions. Moreover, the playing way can be changed.

SUMMARY OF THE INVENTION

Accordingly, the primary object of the present invention is to provide an assembled building block formed by nineteen unit assemblies and a plurality of round holes for forming various geometrical shapes of angles 60 degrees, 90 degrees and 120 degrees. The unit assemblies are formed by 1 and 3 to 6 small units integrally, there are five combination and nineteen sub-combination in the assembling of each unit assembly. The small unit of the unit assemblies is a polygon, and 9~83 grooves for receiving the small units are formed on the surface of the building block seat. By the unit assemblies 1~19 to conform with different building block seats, many different assemblies are formed. Moreover, different shapes, such a plane single layers, or a stacked double layers, or a stacked three layers, or pyramids with three to five layers can be assembled by the present invention.

By the aforesaid structure, the small units can be arranged in the building block seat steadily. Various pattern of single, double, three, fourth and five layers patterns can be assembled. The present invention has following advantages.

1. The plane arrangement can be converted into three dimensional assembly.
2. Many easy and difficult assembling ways are provided by the present invention for users of different ages.
3. Expanding the ideas of users.
4. Many variations and combinations are provided. The playing way of the building blocks are expanded extremely.

The various objects and advantages of the present invention will be more readily understood from the following detailed description when read in conjunction with the appended drawing.

DETAILED DESCRIPTION OF THE PREFERRED EMBODIMENTS

Figure 1:
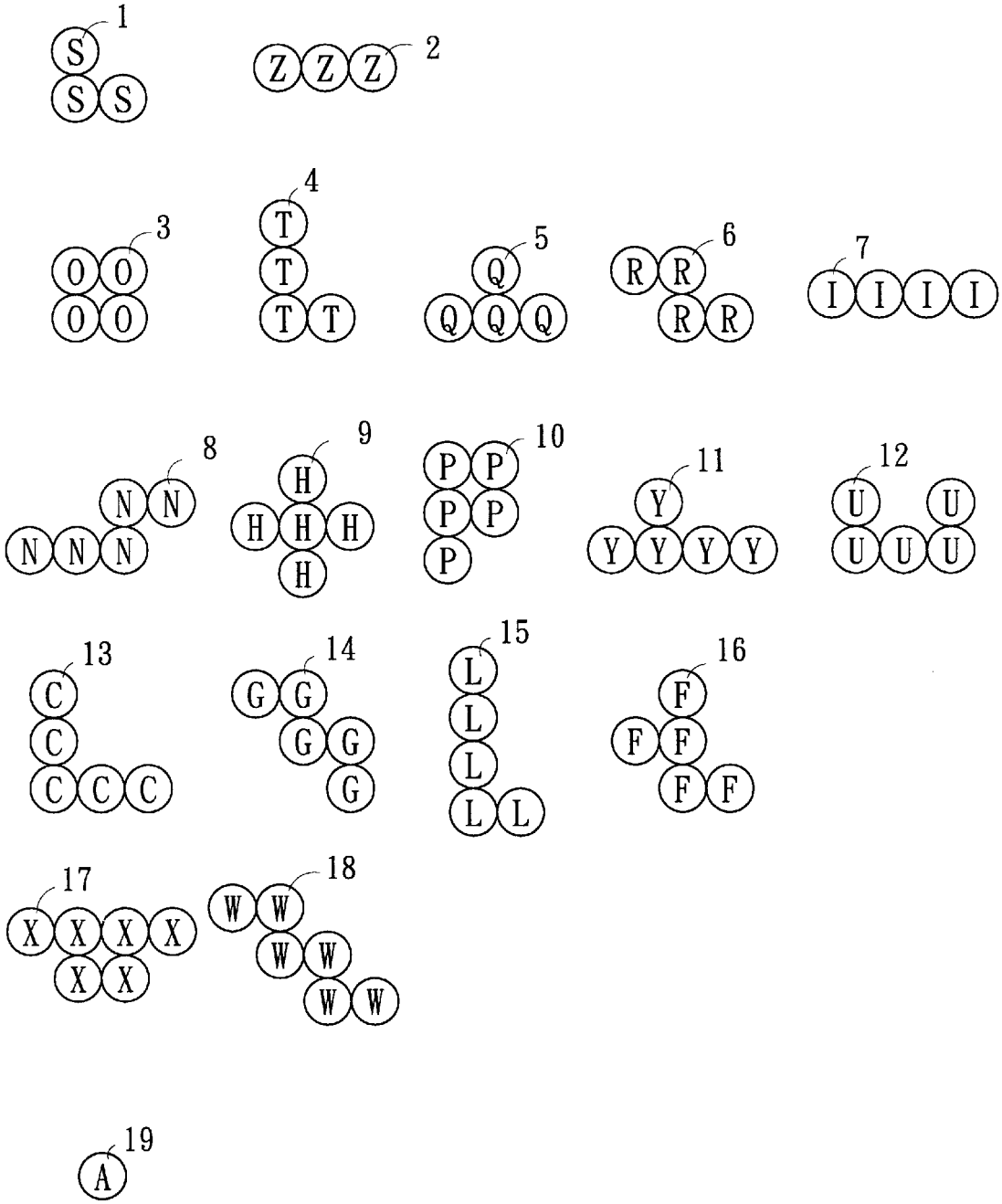
FIG. 1 shows the structure of 18 unit assemblies and a small unit of the present invention.

With reference to FIG. 1, the structures of nineteen unit assemblies 1~19 of the present invention are illustrated. In the figure, the unit assemblies 1~18 are formed by 1 or 3 to 6 small units integrally. While the unit assembly 19 is a single unit. The shape of the small unit may be a ball shape, hexahedron shapes, octahedron shapes, polygons of 16 and 24 surface, and others. The assembling of each unit assembly is:

1. Unit assembly formed by three small units:
   First unit assembly 1: three small units are vertically and horizontally connected equilaterally as a "∟" shape.
   Second unit assembly 2: three small units are horizontally connected as a "-" shape.
2. Unit assembly formed by four small units:
   Third unit assembly 3: four small units are vertically and horizontally connected as a "□" shape.
   Fourth unit assembly 4: four small units are vertically and horizontally connected as a "L" shape.
   Fifth unit assembly 5: four small units are vertically and horizontally connected as a "⊥" shape.
   Sixth unit assembly 6: four small units are vertically and horizontally connected as a "⅂" shape.
   Seventh unit assembly 7: four small units are and horizontally connected as a "—" shape.
3. Unit assembly formed by five small units:
   8th unit assembly 8: five small units are vertically and horizontally connected as a "⅃" shape.
   9th unit assembly 9: five small units are vertically and horizontally connected as a "+" shape.
   10th unit assembly 10: five small units are vertically and horizontally connected as a "P" shape.
   11th unit assembly 11: five small units are vertically and horizontally connected as a "⊥" shape.
   12th unit assembly 12: five small units are vertically and horizontally connected as a "⊔" shape.
   13th unit assembly 13: five small units are vertically and horizontally connected as a "∟" shape.
   14th unit assembly 14: five small units are vertically and horizontally connected as a "⅂" shape.
   15th unit assembly 15: five small units are vertically and horizontally connected as a "L" shape.
   16th unit assembly 16
   five small units are vertically and horizontally connected as a "⅃" shape.
4. Unit assembly formed by six small units:
   17th unit assembly 17: six small units are vertically and horizontally connected as a "⊔" shape.
   18th unit assembly 18: six small units are vertically and horizontally connected as a "⅂" shape.
5. Unit assembly formed by one small unit:
   19th unit assembly 19: a small unit as "." shape.

In the present invention, by the unit assemblies 1~19 to conform to different building block seats, many different assemblies are formed. Moreover, different shapes, such a plane single layers, or a stacked double layers, or a stacked three layers, or pyramids with three to five layers can be formed. The detail will be described in the following:

(1) Arrangement in a single layer plane

Figure 2:
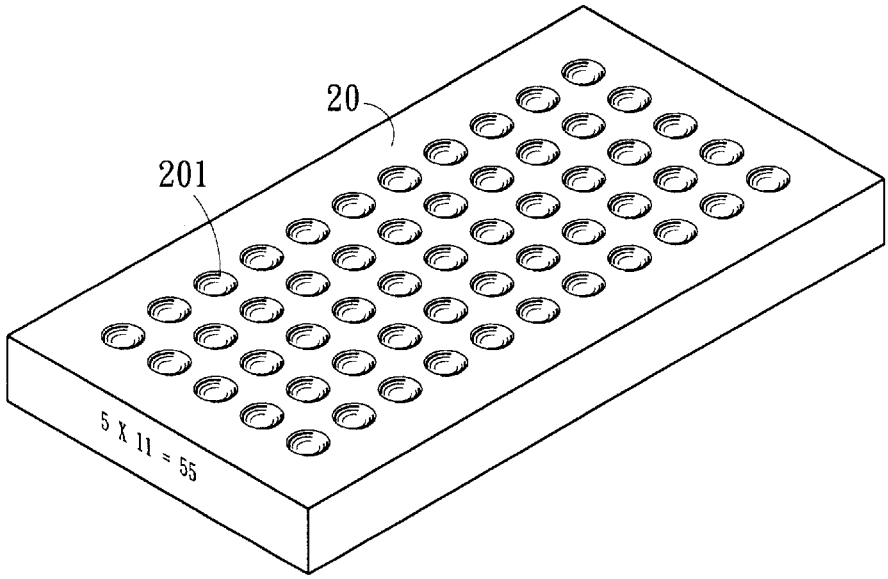
FIG. 2 is a perspective view (1) showing a building block seat with 55 round holes according to the present invention.
Figure 3:
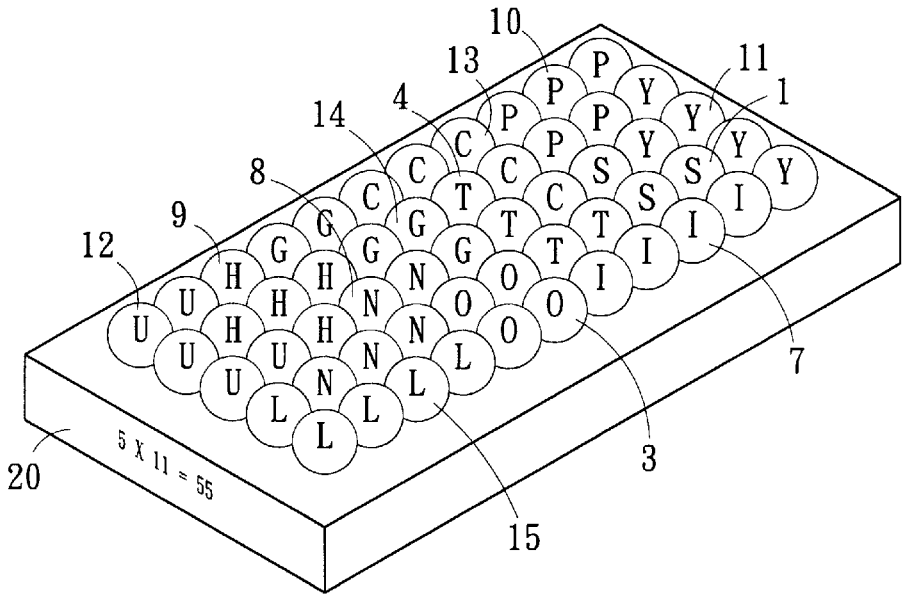
FIG. 3 is a schematic view showing that 12 unit assemblies are arranged in the building block seat of FIG. 2.

As shown in FIG. 2, a rectangular building block seat 20 with 55 (5×11) round holes 201 are illustrated. 12 unit assemblies 1, 3, 4, 7, 8, 9, 10, 11, 12, 13, 14, and 15 are arranged in the building block seat. The 55 small units will fill completely the round holes 201, as shown in FIG. 3.

Figure 4:
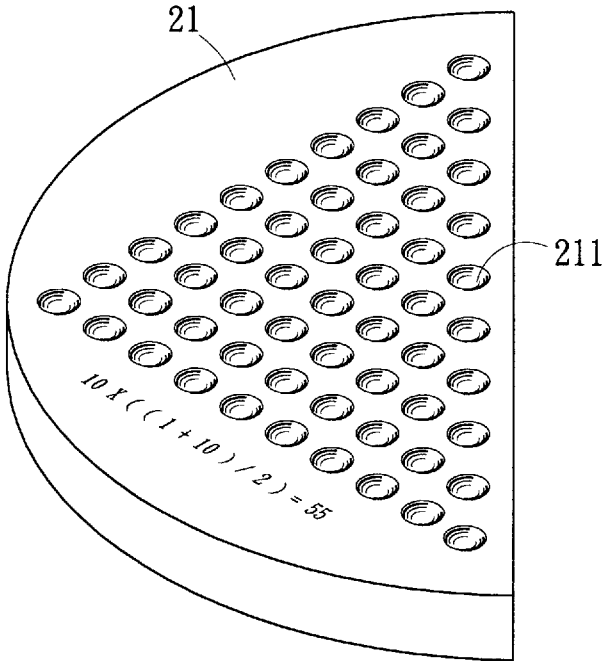
FIG. 4 is a perspective view (2) showing a building block seat with 55 round holes according to the present invention.
Figure 5:
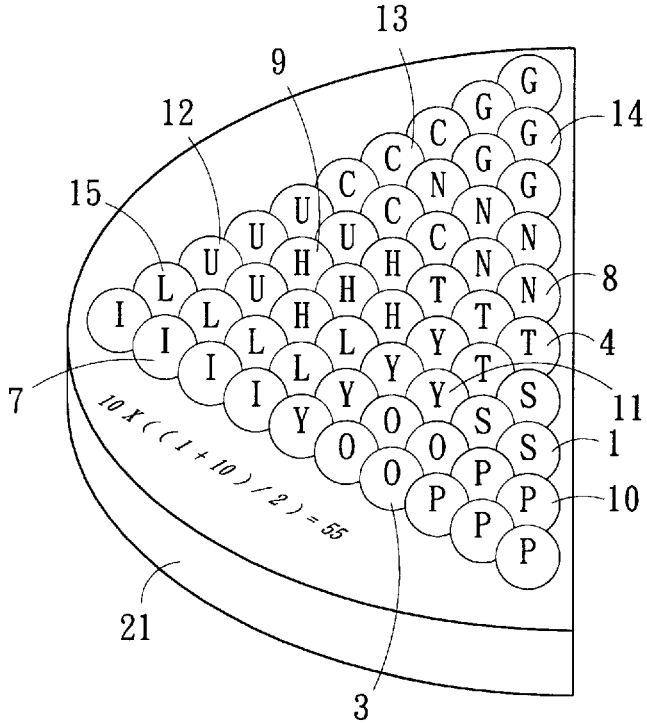
FIG. 5 is a schematic view showing that 12 unit assemblies are arranged in the building block seat of FIG. 4.

As shown in FIG. 4, a triangle building block seat 21 with 55 (10×[1+10 ]÷2) round holes 211 are illustrated. 12 unit assemblies are arranged in the building block seat. The 55 small units will fill completely the round holes 211, as shown in FIG. 5

Figure 6:
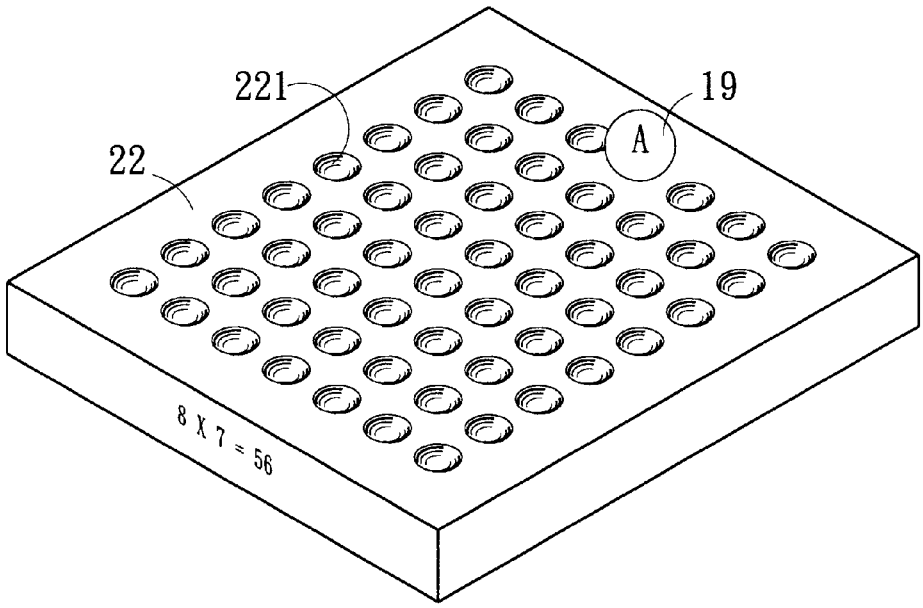
FIG. 6 is a perspective view (1) showing a building block seat with 56 round holes according to the present invention.
Figure 7:
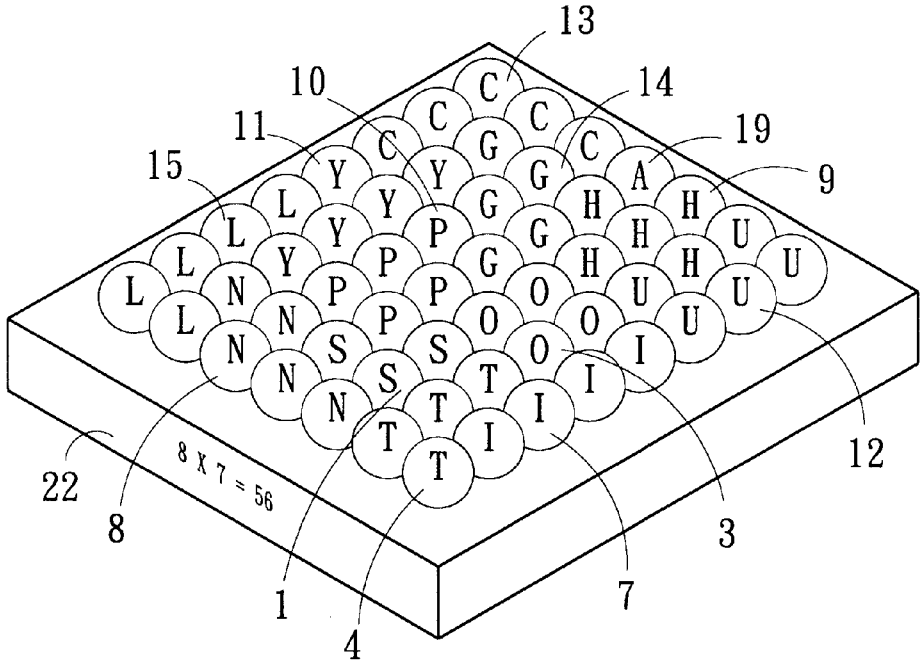
FIG. 7 is a schematic view showing that 13 unit assemblies are arranged in the building block seat of FIG. 6.

As shown in FIG. 6, a rectangular building block seat 22 with 56 (8×7) round holes 221 are illustrated. 12 identical unit assemblies (totally 55 small units) are arranged in the building block seat, and then the $19^{th}$ (one small unit) is used to fill the remained unit assembly. The 56 small units will fill completely the round holes 221. as shown in FIG. 7.

Figure 8:
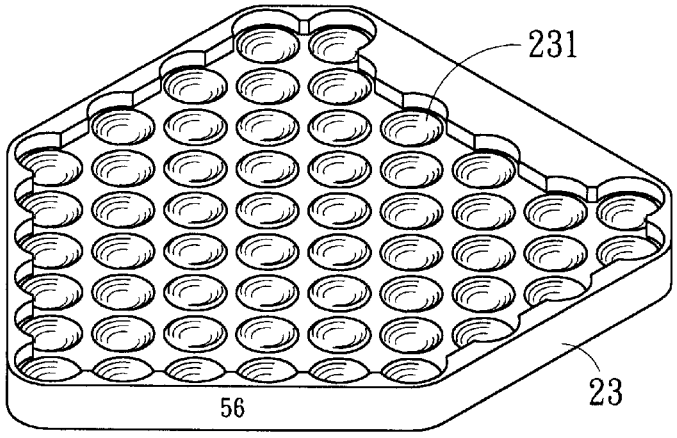
FIG. 8 is a perspective view (2) showing a building block seat with 56 round holes.
Figure 9:
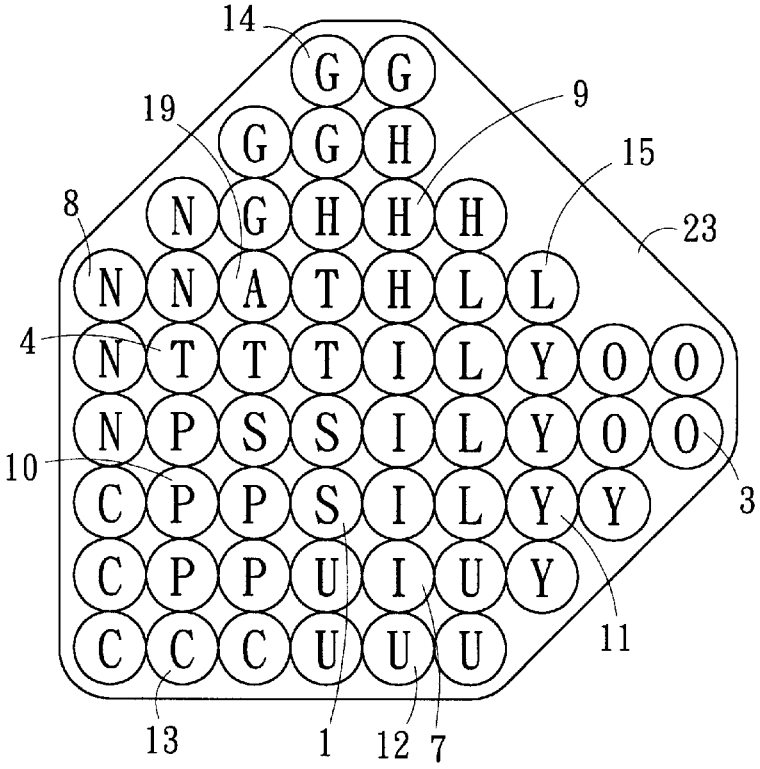
FIG. 9 is a schematic view showing that 13 unit assemblies are arranged in the building block seat of FIG. 8.

FIG. 8 shows a building block seat 23 formed by 56 round holes 231. 12 identical unit assemblies are arranged within the building block seat 23 in advance (totally 55 units). Finally, unit assembly 19 serves to fill the remained round holes 231, as shown in FIG. 9.

Figure 10:
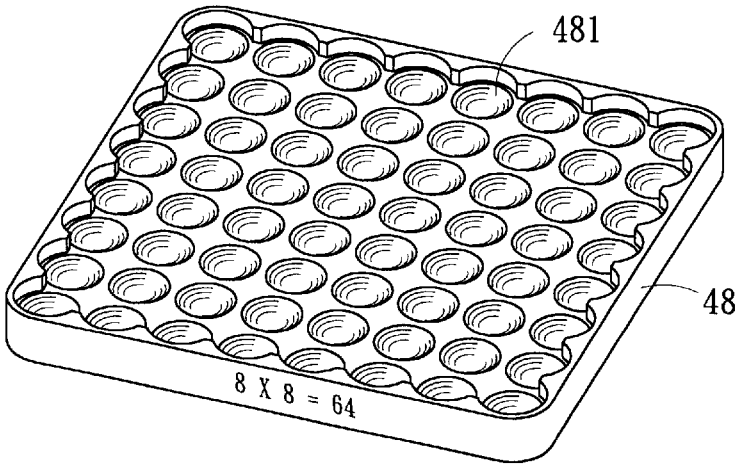
FIG. 10 shows the structure of a building block seat with 64 round holes.
Figure 11:
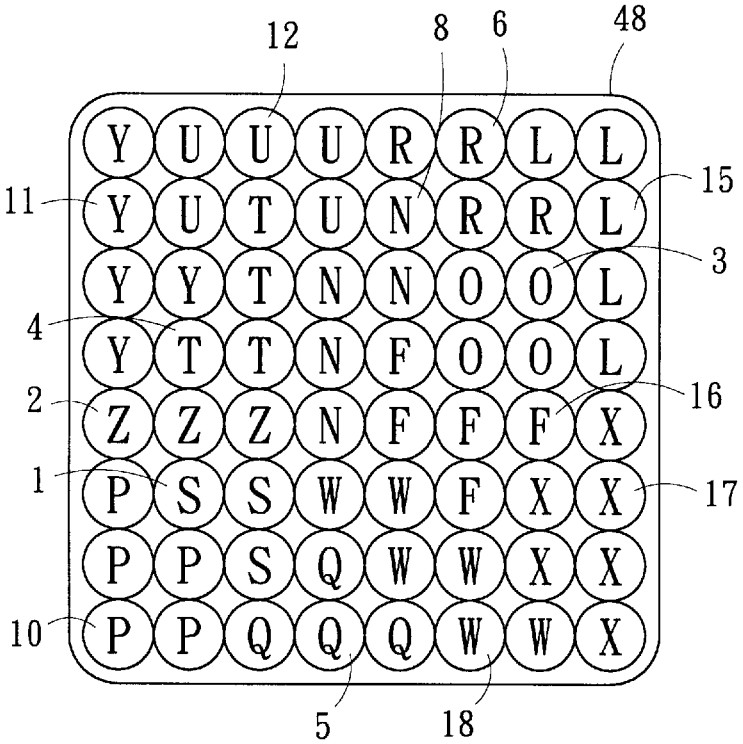
FIG. 11 is a schematic view showing 14 unit assemblies being arranged in the building block seat of FIG. 10.

As shown in FIG. 10, 64 (8×8) round holes 481 are arranged into 14 unit assemblies 1, 2, 3, 4, 5, 6, 8, 10, 11, 12, 15, 16, 17 and 18 in a rectangular building block seats 48 with an angles of 90 degrees. The 64 units are filled into all the round holes 481, as shown in FIG. 11.

Figure 12:
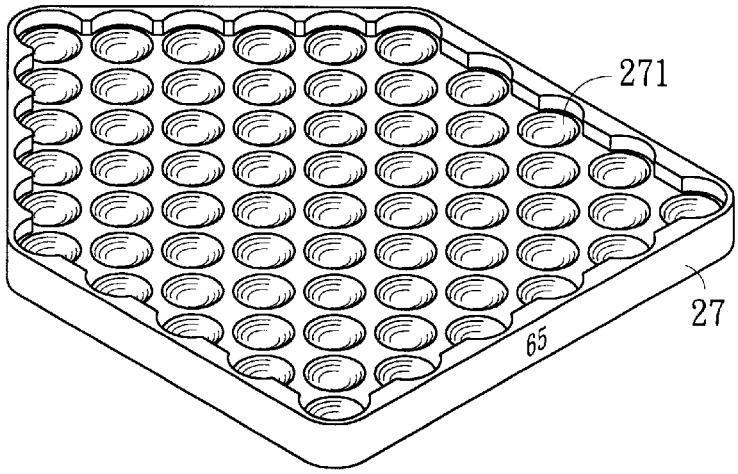
FIG. 12 is a structure showing a building block seat with 65 round holes according to the present invention.
Figure 13:
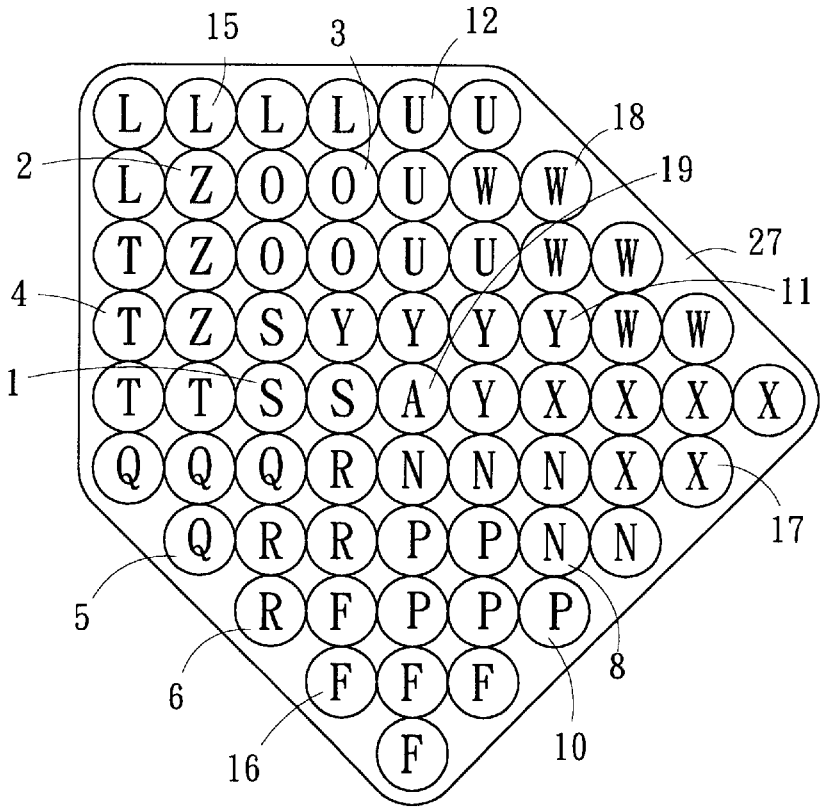
FIG. 13 is a schematic view showing 15 unit assemblies being arranged within the building block seat of FIG. 12.

As shown in FIG. 12, 65 round holes 271 are arranged into 14 unit assemblies 1, 2, 3, 4, 5, 6, 8, 10, 11, 12, 15, 16, 17 and 18 (totally 64 small units) in a triangle building block seats 27 with an angles of 90 degrees and 120 degrees. Finally, unit assembly 19 serves to fill the unfilled space. The 65 units are filled into all the round holes 271, as shown in FIG. 13.

Figure 14:
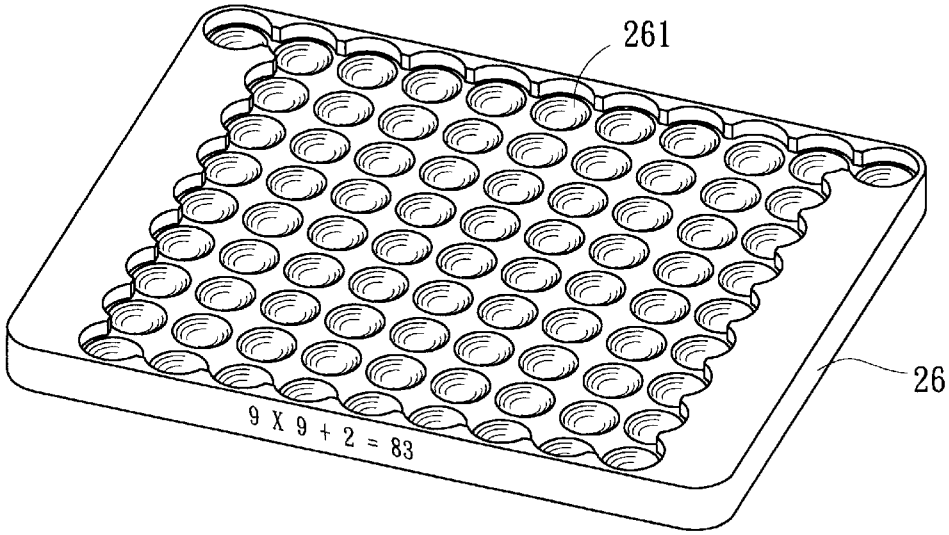
FIG. 14 is a structure showing a building block seat with 83 round holes according to the present invention.
Figure 15:
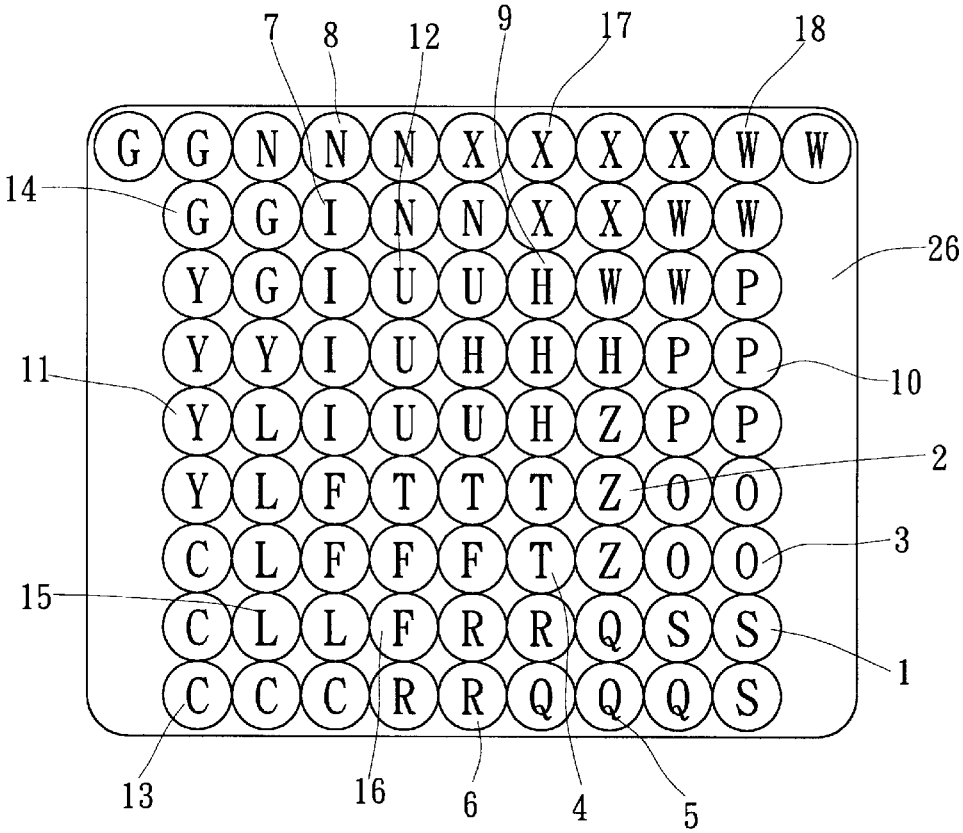
FIG. 15 is a schematic view showing 18 unit assemblies being arranged within the building block seat of FIG. 14.

As shown in FIG. 14, 83 round holes 261 are arranged in a rectangular building block seats 26 with an angles of 90 degrees and 120 degrees. Two through holes are installed at corners of the rectangular pattern. 88 unit assemblies 1~18 can be arranged in the building block seat. 83 units are filled into all the round holes 271, as shown in FIG. 13.

(2) Arrangement in a Pyramid

Figure 16:
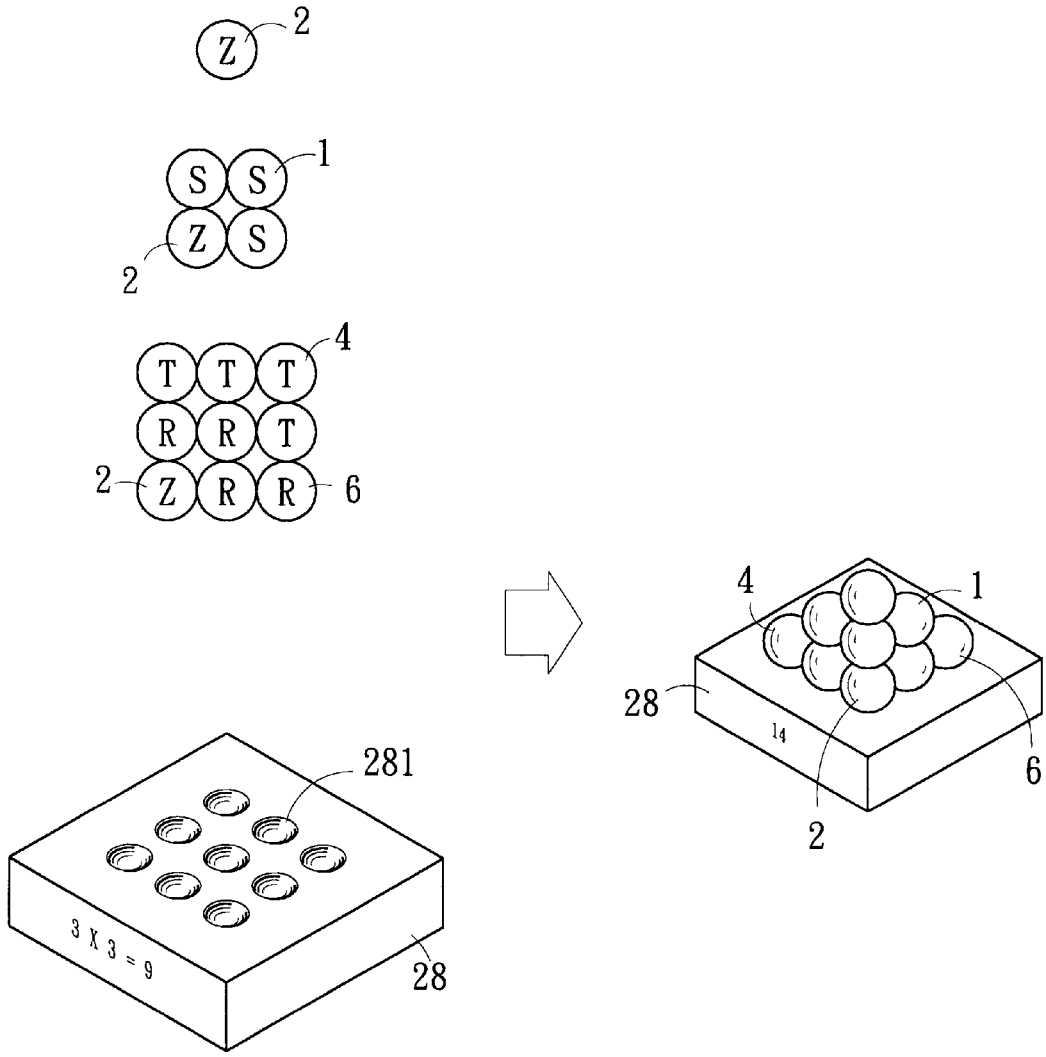
FIG. 16 is a schematic view showing a three layer pyramid being stacked on a building block seat of the present invention.

FIG. 16 shows a three layer pyramid arrangement. In a rectangular building block seat 28 with 9 (3×3) round holes 281, four unit assemblies 1, 2, 4, and 6 are stacked. 14 small units are formed with a three layer pyramid.

Figure 17:
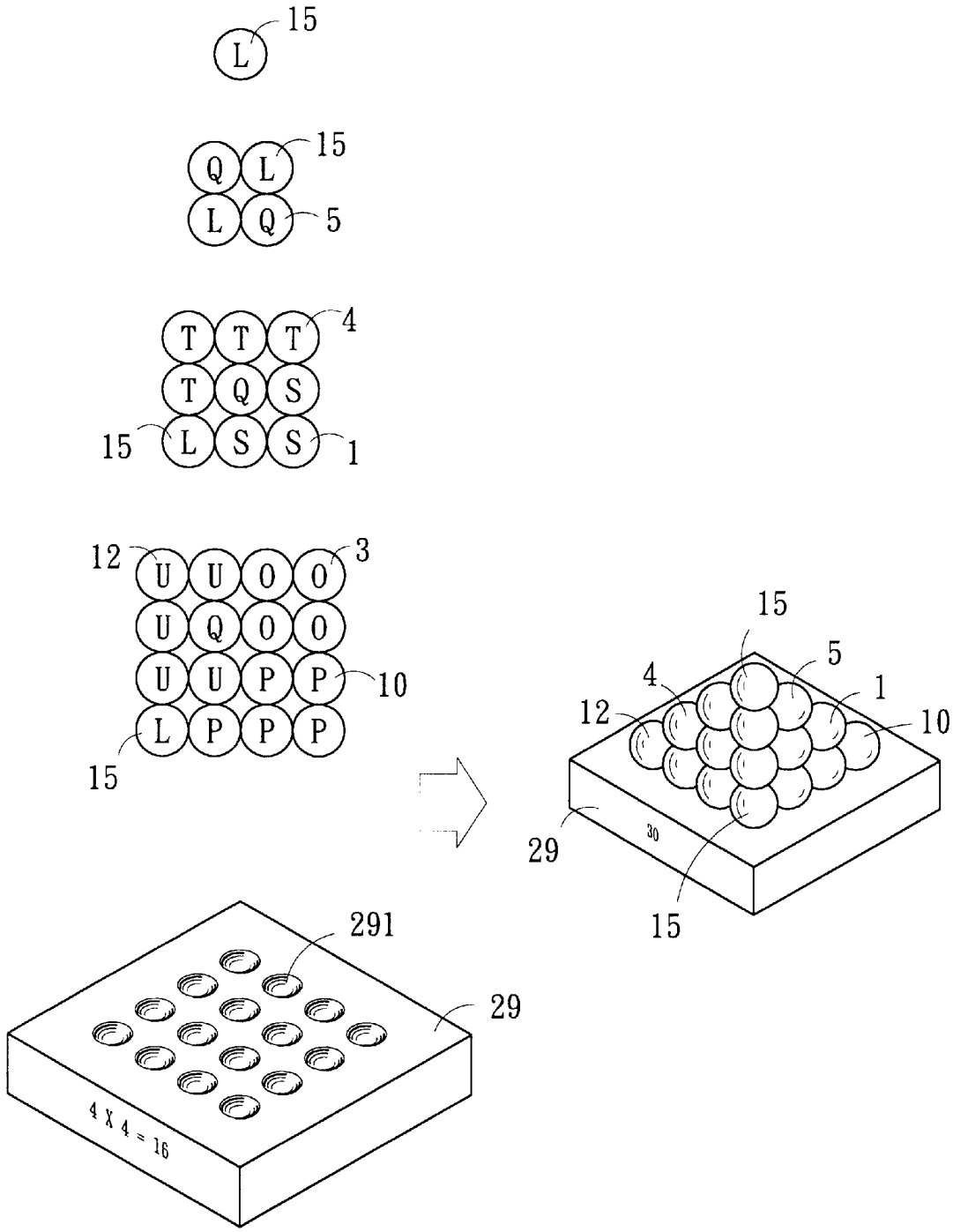
FIG. 17 is a schematic view showing a four layer pyramid being stacked on a building block seat of the present invention.

FIG. 17 shows a 4 layer pyramid arrangement. In a rectangular building block seat 29 with 16 (4×4) round holes 291, seven unit assemblies 1, 3, 4, 5, 10, 12 and 15 are stacked. 30 small units are formed with a four layer pyramid.

Figure 18:
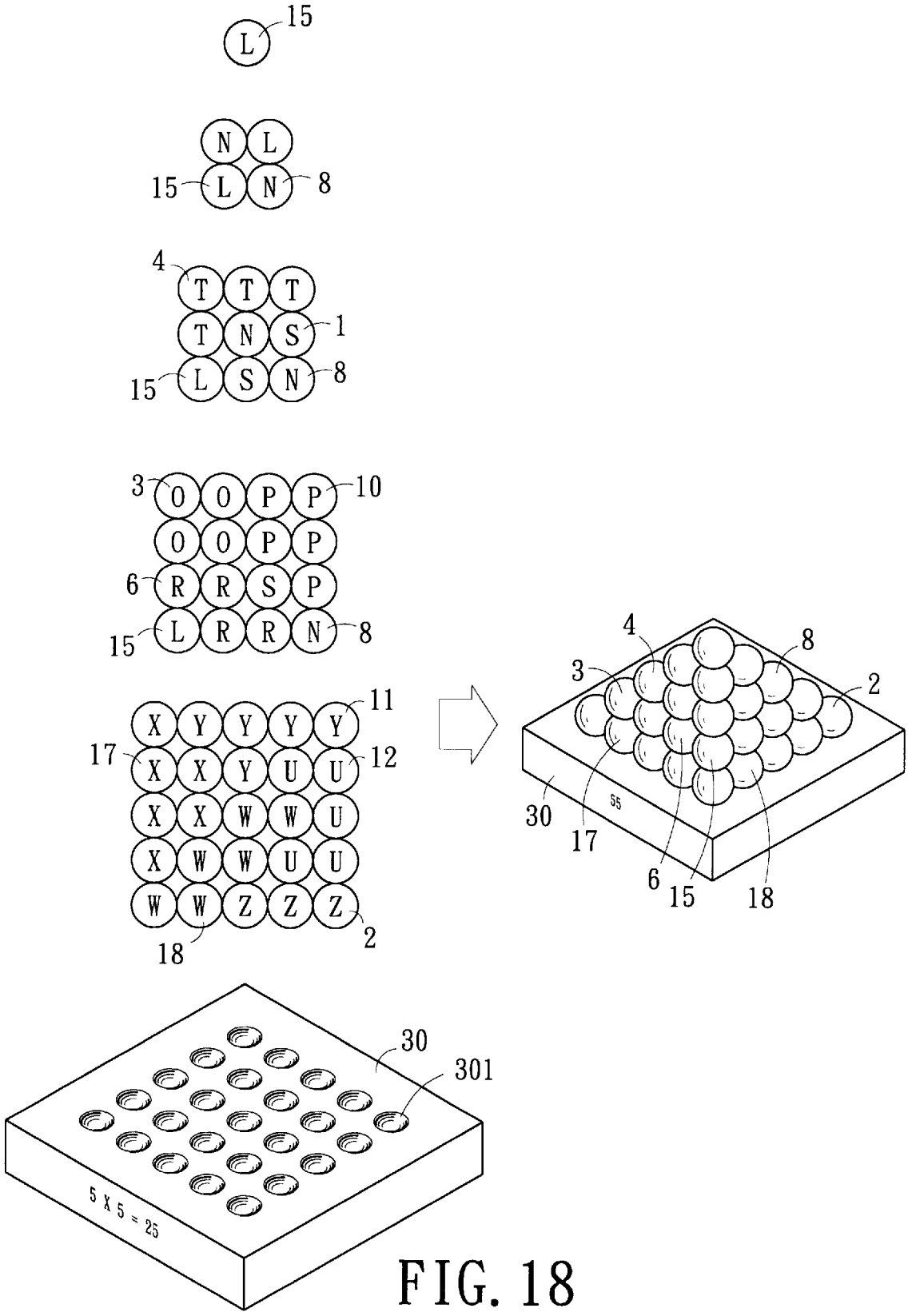
FIG. 18 is a schematic view (1) showing a five layer pyramid being stacked on a building block seat of the present invention.

FIG. 18 shows a 5 layer pyramid arrangement. In a rectangular building block seat 30 with 25 (5×5) round holes 301, 12 unit assemblies 1, 2, 3, 4, 6, 8, 10, 11, 12, 15, 17 and 18 are stacked. 55 small units are formed with a five layer pyramid.

Figure 19:
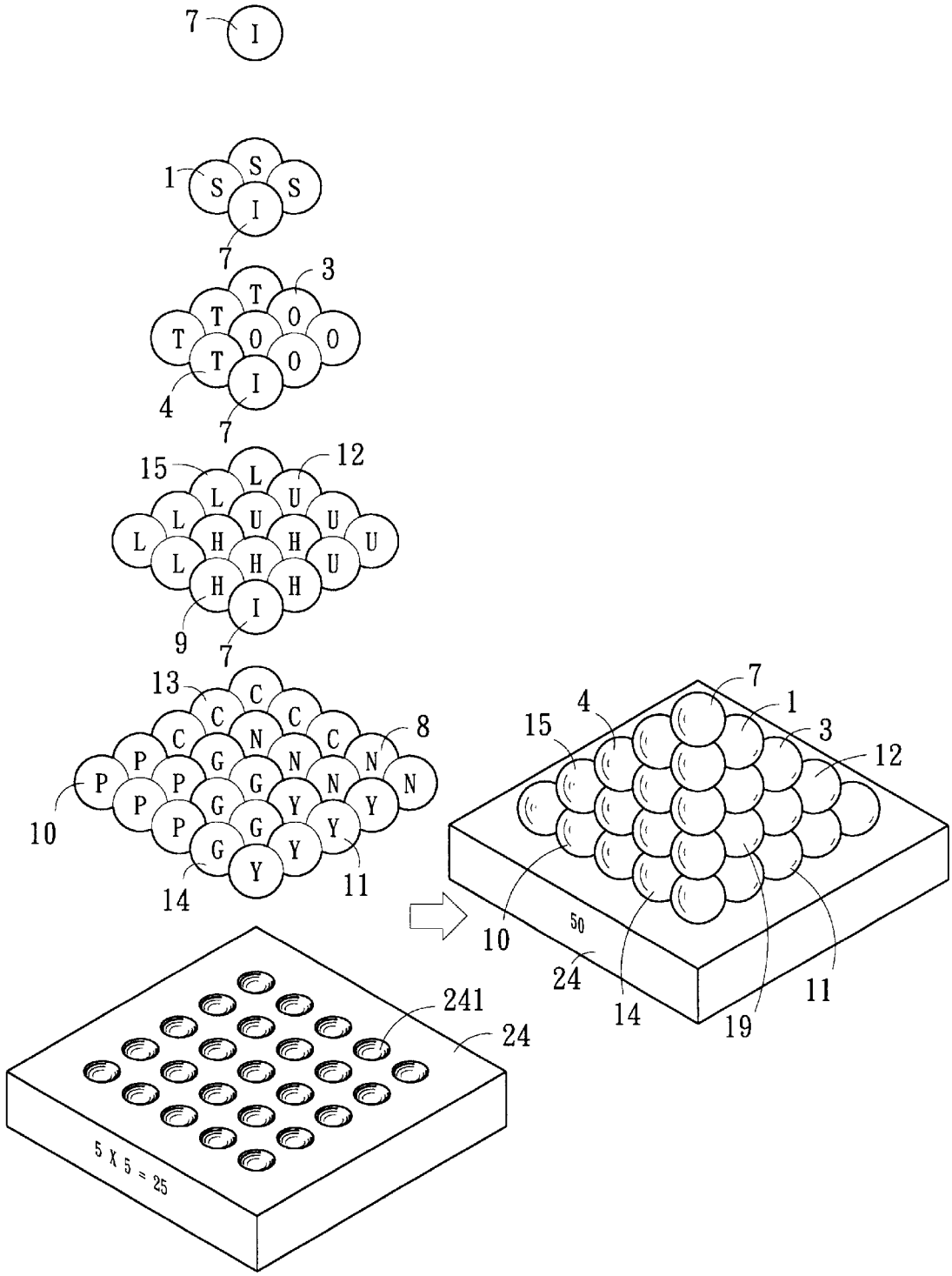
FIG. 19 is a schematic view (2) showing a five layer pyramid being stacked on a building block seat of the present invention.

FIG. 19 shows a 5 layer pyramid arrangement. In a rectangular building block seat 24 with 25 (5×5) round holes 241, twelve unit assemblies 1, 3, 4, 7, 8, 9, 10, 11, 12, 13, 14 and 15 are stacked. 55 small units are formed with a five layer pyramid.

(3) 60 Degrees Triangle Three Dimensional Arrangement

Figure 20:
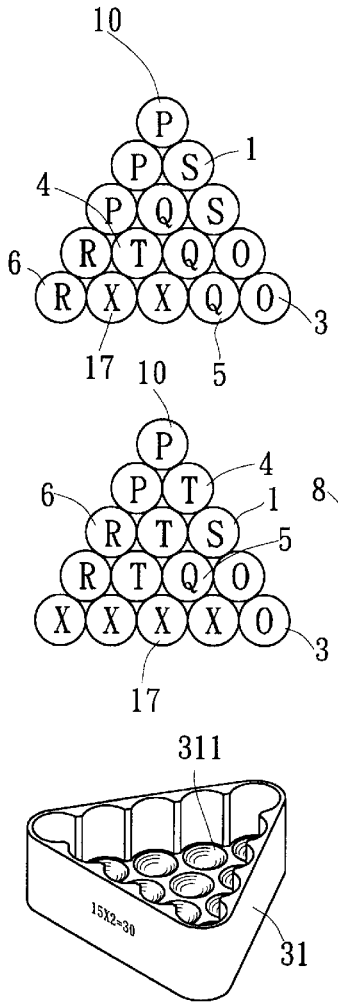
FIG. 20 is a schematic view showing a double layer triangle being stacked on the building block seat of the present invention.

FIG. 20 shows a double layer 60 degrees triangle three dimensional arrangement. In a triangle building block seat 31 (box type) with 15 round holes 311, seven unit assemblies 1, 3, 4, 5, 6, 10 and 17 are stacked. 30 small units are formed with a double layer three dimensional triangle.

Figure 21:
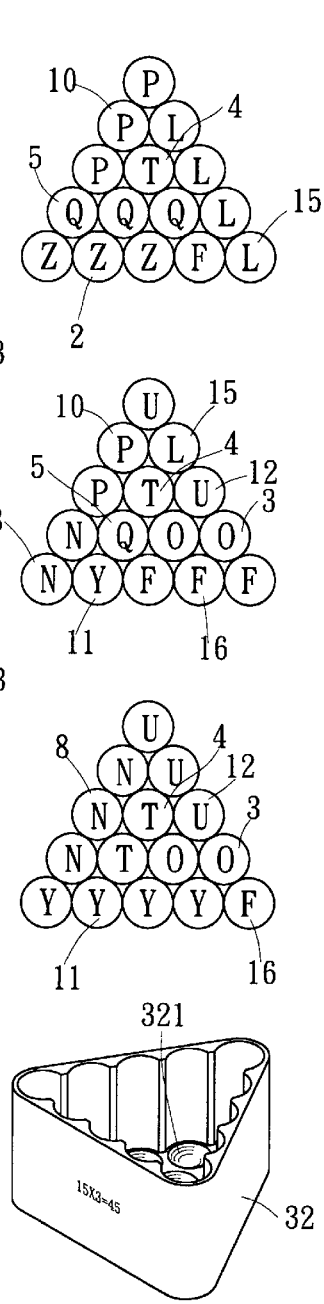
FIG. 21 is a schematic view showing a three layer triangle being stacked on the building block seat of the present invention.

FIG. 21 shows a three layer 60 degrees triangle three dimensional arrangement. In a triangle building block seat 32 (box type) with 15 round holes 321, ten unit assemblies 2, 3, 4, 5, 8. 10, 11, 12, 15 and 16 are stacked. 45 small units are formed with a three layer three dimensional triangle.

Figure 22:
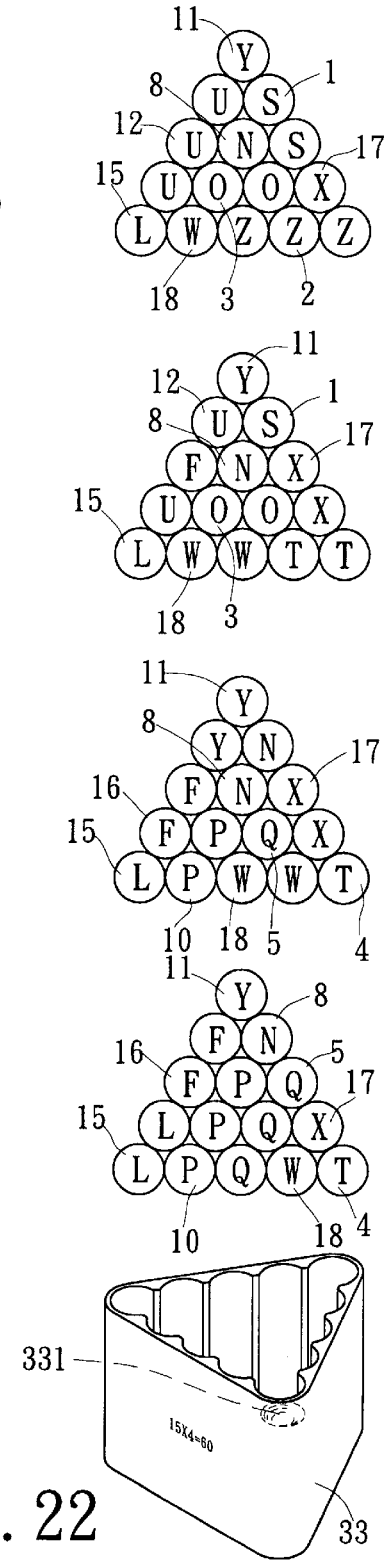
FIG. 22 is a schematic view showing a four layer triangle being stacked on the building block seat of the present invention.

FIG. 22 shows a four layer 60 degrees triangle three dimensional arrangement. In a triangle building block seat 33 (box type) with 15 round holes 331, thirteen unit assemblies 1, 2, 3, 4, 5, 8, 10, 11, 12, 15, 16, 17 and 18 are stacked. 60 small units are formed with a four layer three dimensional triangle.

Figure 23:
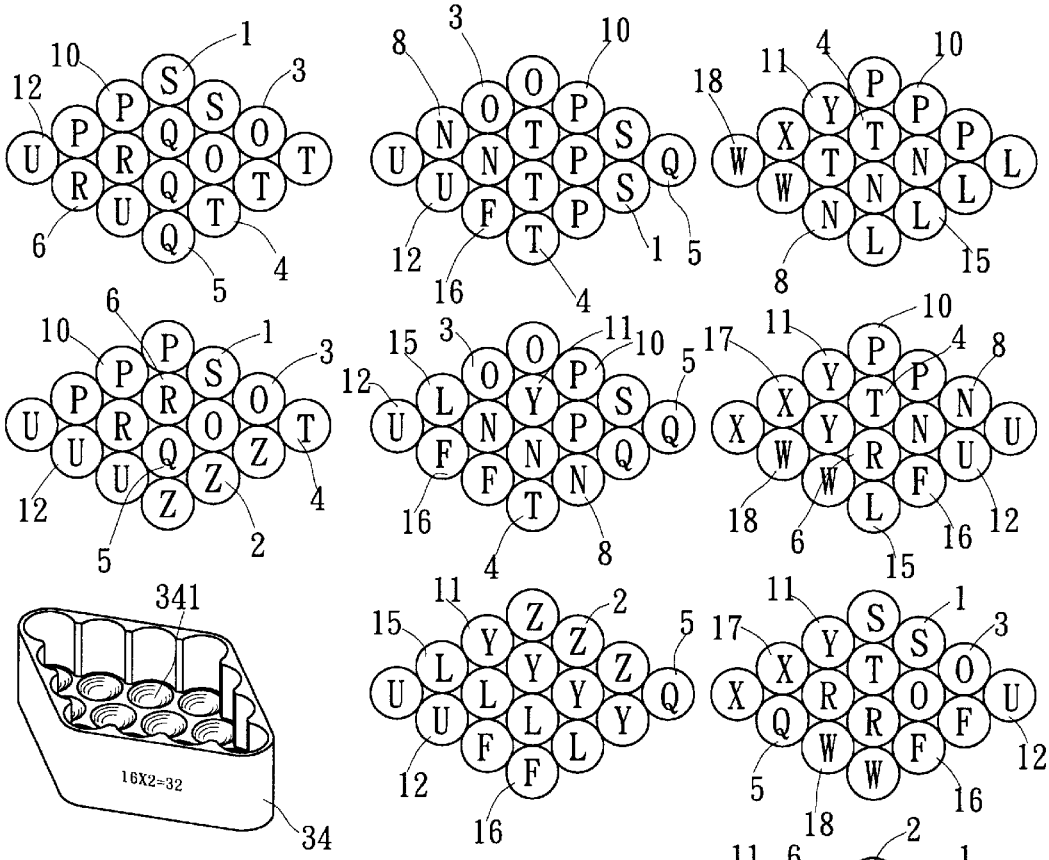
FIG. 23 is a schematic view showing a double layer rhombus being stacked on the building block seat of the present invention.

(4) A 60 degrees and 120 degrees three dimensional rhombic arrangement:

FIG. 23 shows a double layer 60 degrees and 120 degrees rhombic three dimensional arrangement. In a rhombic building block seat 34 (box type) with 16 round holes 341, eight unit assemblies 1, 2, 3, 4, 5, 6, 10, and 12 are stacked. 32 small units are formed with a double layer three dimensional rhombus.

Figure 24:
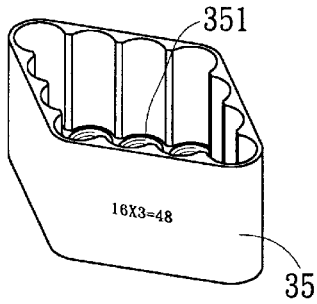
FIG. 24 is a schematic view showing a three layer rhombus being stacked on the building block seat of the present invention.

FIG. 24 shows a three layer 60 degrees and 120 degrees rhombic three dimensional arrangement. In a rhombic building block seat 35 (box type) with 16 round holes 351, ten unit assemblies 2, 3,4, 5, 6, 10, 11, 12, 15 and 16 are stacked. 48 small units are formed with a three layer three dimensional rhombus.

Figure 25:
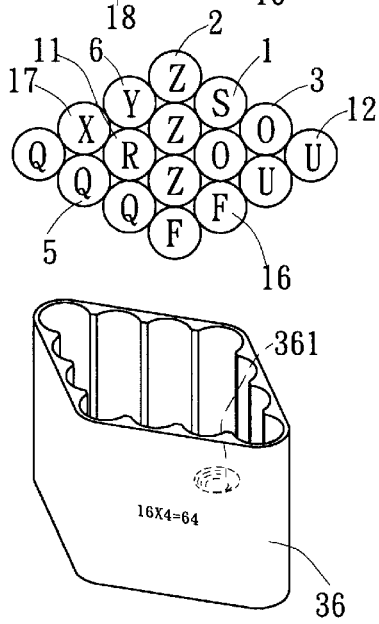
FIG. 25 is a schematic view showing a four layer rhombus being stacked on the building block seat of the present invention.

FIG. 25 shows a four layer 60 degrees and 120 degrees rhombic three dimensional arrangement. In a rhombic building block seat 36 (box type) with 16 round holes 361, fourteen unit assemblies 1, 2, 3. 4, 5, 6, 8, 10, 11, 12, 15, 16 17, and 18 are stacked. 6 small units are formed with a fourth layer three dimensional rhombus.

(5) 120 degrees unequilateral hexagonal three dimensional arrangement

Figure 26:
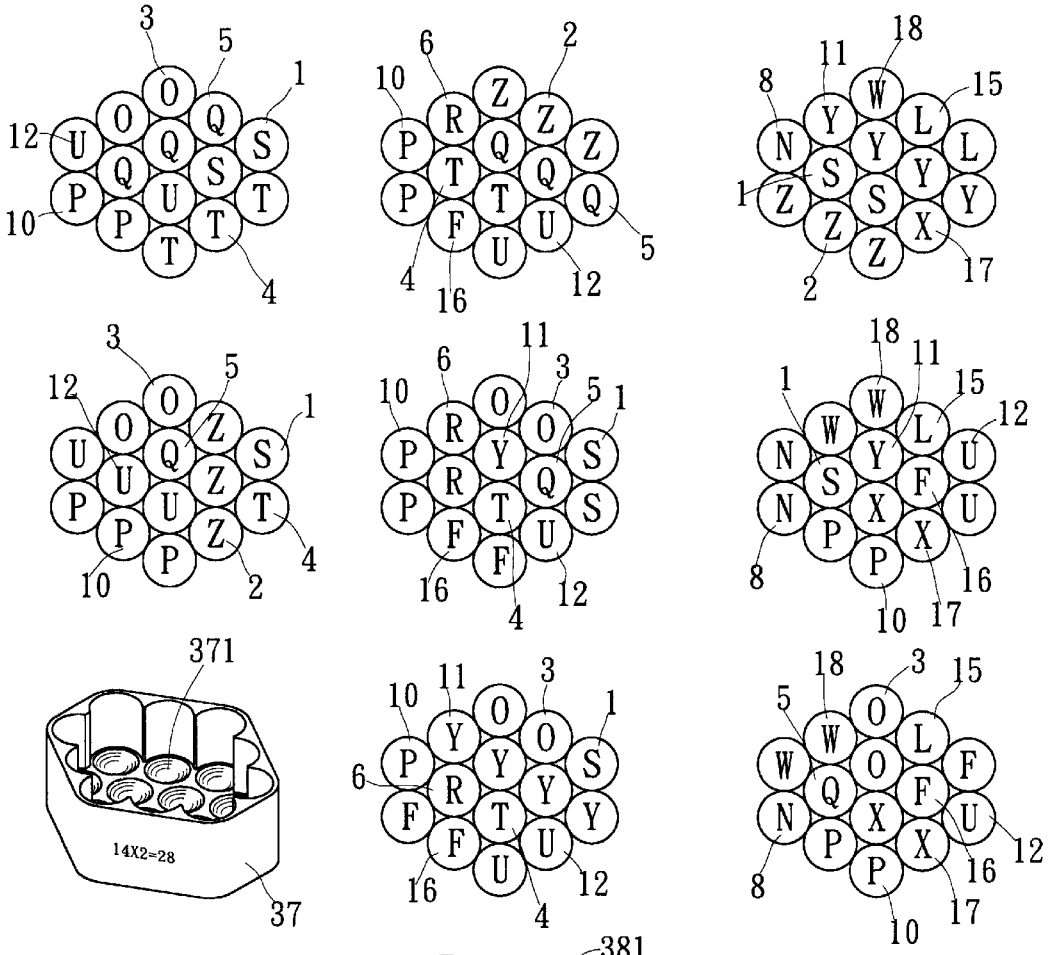
FIG. 26 is a schematic view showing a double layer unequilateral hexagon being stacked on the building block seat of the present invention.

FIG. 26 shows a double layer 120 degrees unequilateral hexagonal three dimensional arrangement. In an unequilateral hexagonal building block seat 37 (box type) with 14 round holes 371, seven unit assemblies 1, 2, 3, 4, 5, 10, and 12 are stacked. 28 small units are formed with a double layer three dimensional unequilateral hexagon.

Figure 27:
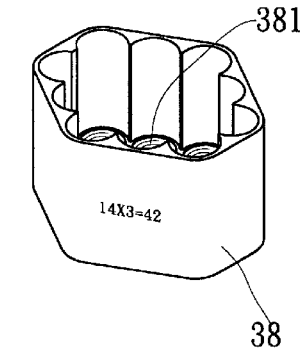
FIG. 27 is a schematic view showing a three layer unequilateral hexagon being stacked on the building block seat of the present invention.

FIG. 27 shows a three layer 120 degrees unequilateral hexagonal three dimensional arrangement. In an unequilateral hexagonal rhombic building block seat 38 (box type) with 14 round holes 381, ten unit assemblies 1, 2, 3, 4, 5, 6, 10, 11, 12 and 16 are stacked. 42 small units are formed with a three layer three dimensional unequilateral hexagon.

Figure 28:
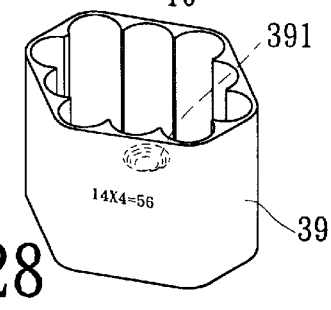
FIG. 28 is a schematic view showing a four layer unequilateral hexagon being stacked on the building block seat of the present invention.

FIG. 28 shows a fourth layer 120 degrees unequilateral hexagonal three dimensional arrangement. In an unequilateral hexagonal building block seat 39 (box type) with 14 round holes 391, twelve unit assemblies 1, 2, 3, 5, 8, 10, 11, 12, 15, 16, 17 and 18 are stacked. 56 small units are formed with a fourth layer three dimensional unequilateral hexagon.

(6) 120 degrees equilateral hexagonal three dimensional arrangement

Figure 29:
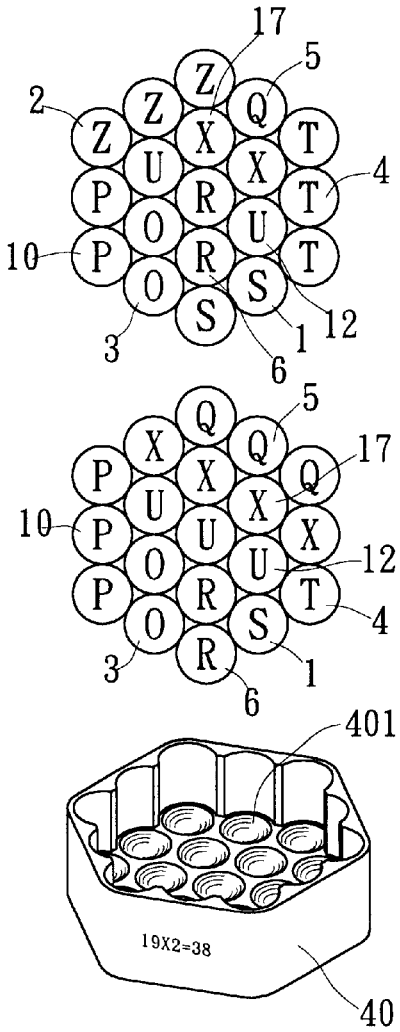
FIG. 29 is a schematic view showing a double layer equilateral hexagon being stacked on the building block seat of the present invention.

FIG. 29 shows a double layer 120 degrees equilateral hexagonal three dimensional arrangement. In an equilateral hexagonal building block seat 40 (box type) with 19 round holes 401, nine unit assemblies 1, 2, 3, 4, 5, 6, 10, 12 and 17 are stacked. 38 small units are formed with a double layer three dimensional equilateral hexagon.

Figure 30:
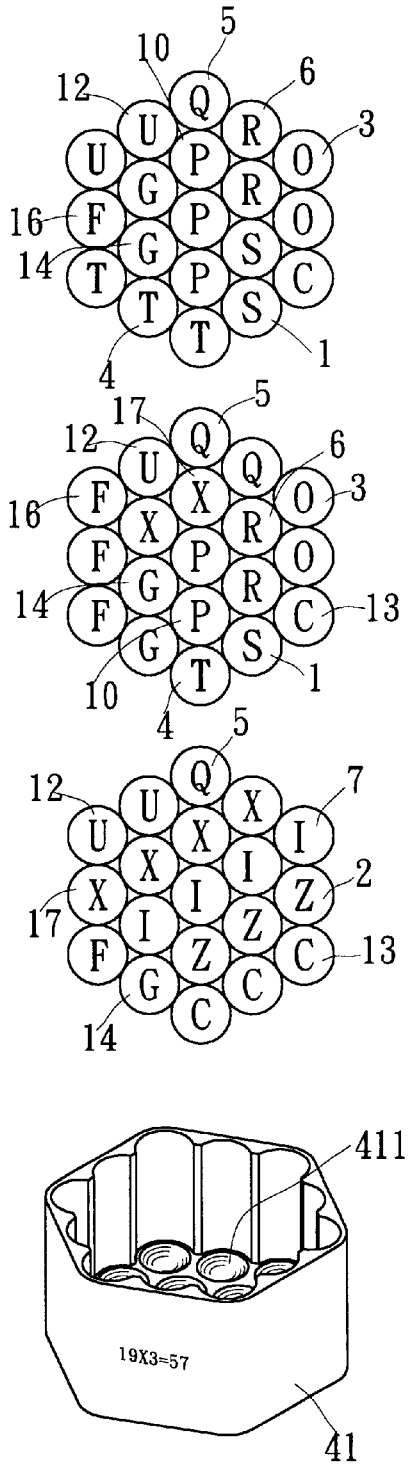
FIG. 30 is a schematic view showing a three layer equilateral hexagon being stacked on the building block seat of the present invention.

FIG. 30 shows a three layer 120 degrees equilateral hexagonal three dimensional arrangement. In an equilateral hexagonal building block seat 41 (box type) with 19 round holes 411, thirteen unit assemblies 1,2, 3, 4, 5, 6, 7, 10, 12, 13, 14, 16 and 17 are stacked. 57 small units are formed with a three layer three dimensional equilateral hexagon.

(4) 90 degrees 4×4 plane and three dimensional rectangular arrangement

Figure 31:
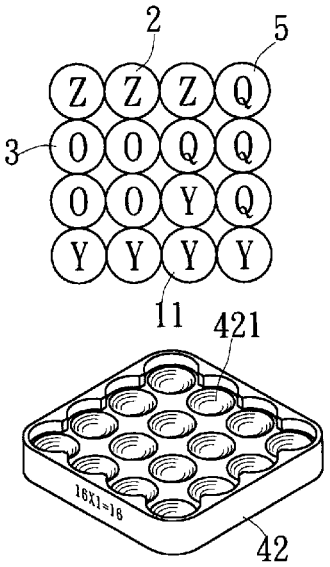
FIG. 31 is a schematic view showing a double layer unequilateral hexagon being stacked on the building block seat of the present invention.

FIG. 31 shows a single layer 90 degrees 4×4 plane and three dimensional rectangular arrangement. In a rectangular building block seat 42 (box type) with 16 round holes 421, four unit assemblies 2, 3,5, and 11 are stacked. 16 small units are formed with a single layer plane rectangle.

Figure 32:
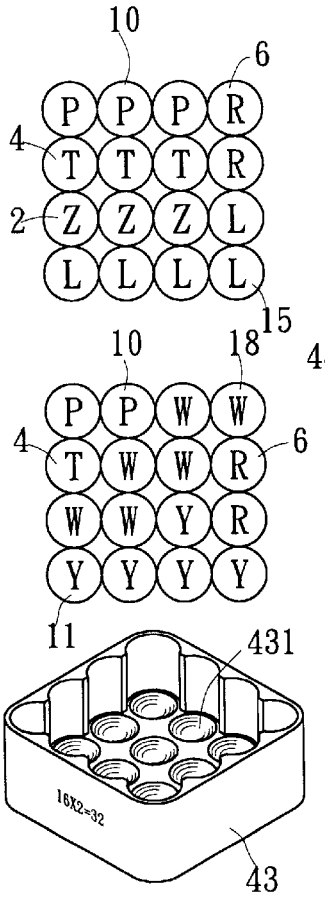
FIG. 32 is a schematic view showing a double layer three dimensional rectangle being stacked on the building block seat of the present invention.

FIG. 32 shows a double layer 90 degrees 4×4 plane and three dimensional rectangular arrangement. In a rectangular building block seat 43 (box type) with 16 round holes 431, seven unit assemblies 2, 4,6, 10, 11, 15, and 18 are stacked. 32 small units are formed with a double layer plane rectangle.

Figure 33:
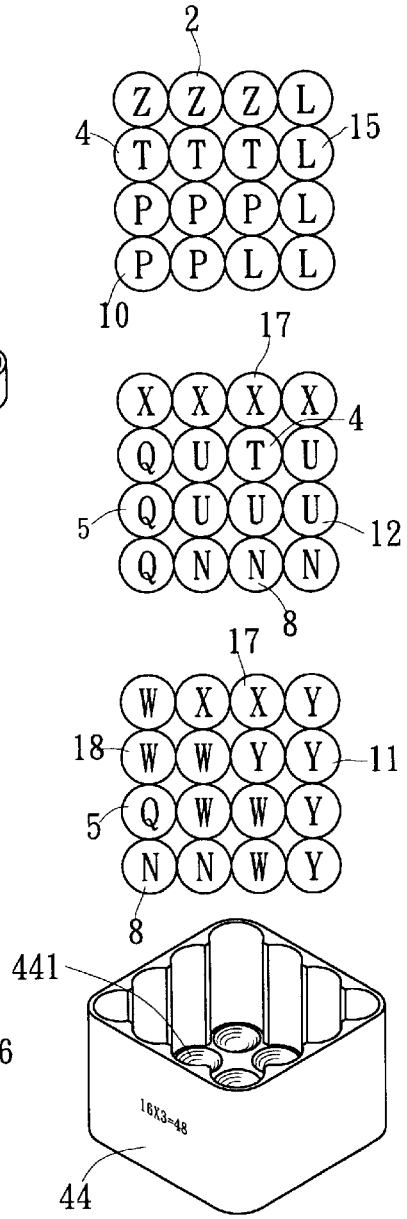
FIG. 33 is a schematic view showing a three layer three dimensional rectangle being stacked on the building block seat of the present invention.
Figure 34:
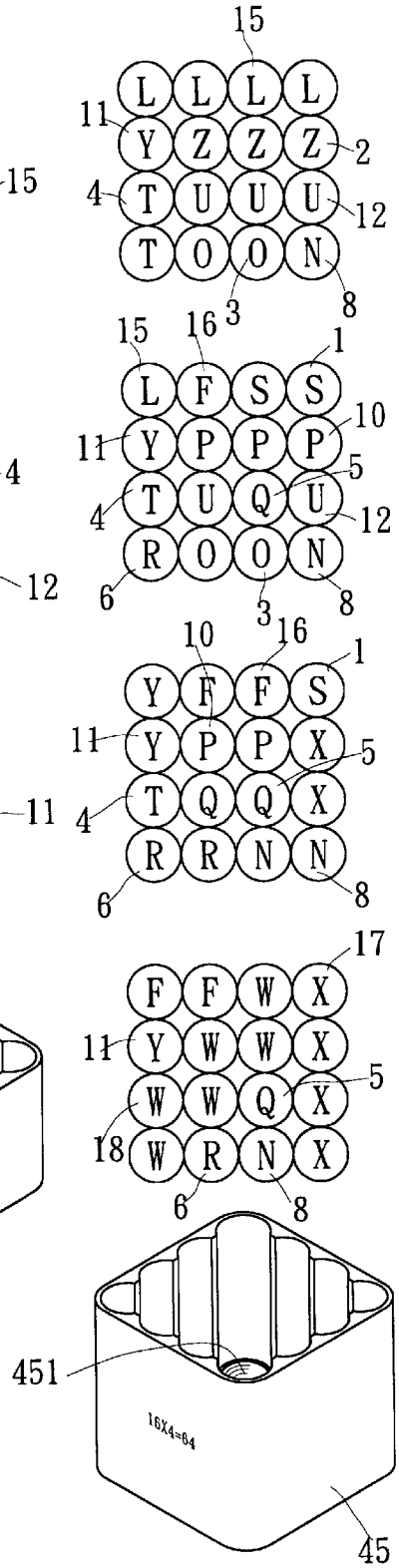
FIG. 34 is a schematic view showing a four layer three dimensional rectangle being stacked on the building block seat of the present invention.

FIG. 33 shows a three layer 90 degrees 4×4 plane and three dimensional rectangular arrangement. In a rectangular building block seat 44 (box type) with 16 round holes 441, ten unit assemblies 2, 4, 5, 8, 10, 11, 12, 15, 17 and 18 are stacked. 48 small units are formed with a three layer plane rectangle.

FIG. 33 shows a four layer 90 degrees 4×4 plane and three dimensional rectangular arrangement. In a rectangular building block seat 45 (box type) with 16 round holes 451, fourth unit assemblies 1, 2, 3, 4,5, 6, 8, 10, 11, 12, 15, 16, 17 and 18 are stacked. 64 small units are formed with a four layer plane rectangle.

(4) 90 degrees 5×5 plane and three dimensional rectangular arrangement

Figure 35:
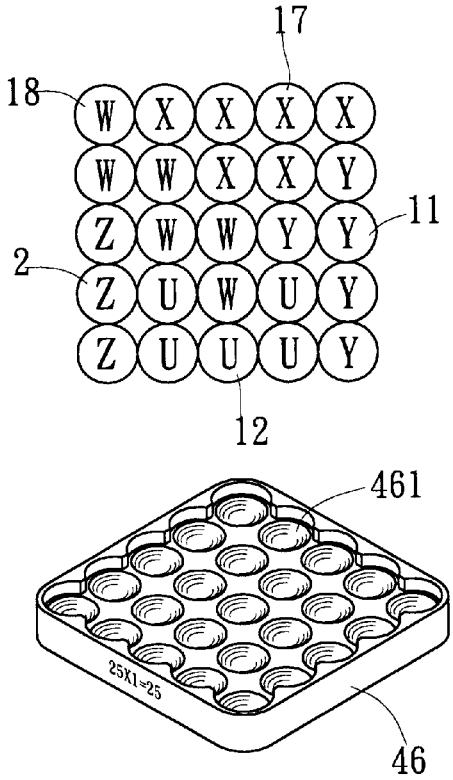
FIG. 35 is a schematic view showing a single layer plane rectangle being stacked on the building block seat of the present invention.

FIG. 35 shows that in a rectangular building block seat 46 (box type) with 25 round holes 461, five unit assemblies 2, 11, 12, 17 and 18 are stacked. 46 small units are formed with a single layer plane rectangle.

Figure 36:
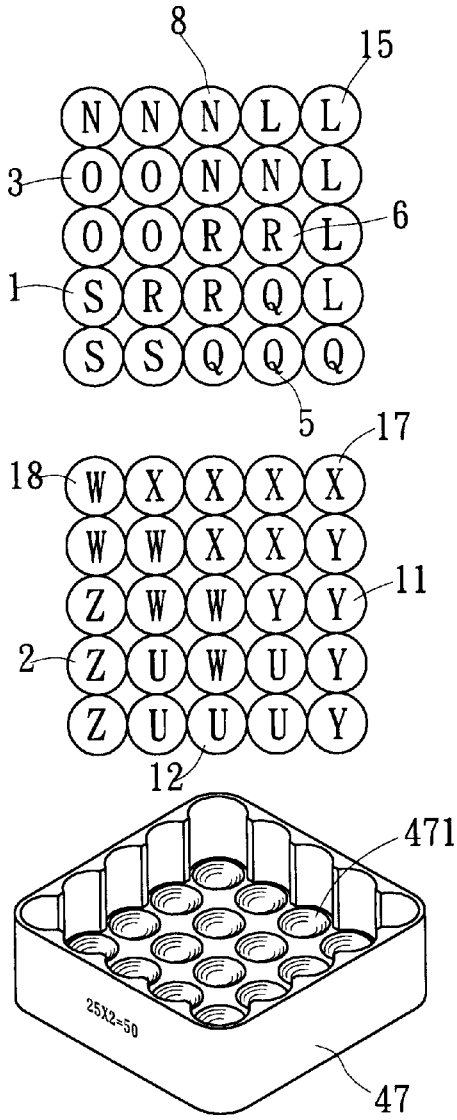
FIG. 36 is a schematic view showing a double layer three dimensional rectangle being stacked on the building block seat of the present invention.

FIG. 36 shows that in a rectangular building block seat 47 (box type) with 25 round holes 471, eleven unit assemblies 2, 11, 12, 17 and 18 and 1, 3, 5, 6, 8, and 15 are stacked. 50 small units are formed with a double layer plane rectangle.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An assembled building blocks formed by nineteen unit assemblies and a plurality of round holes for forming various geometrical shapes having corners of angles 60 degrees, 90 degrees and 120 degrees, characterized in that:

the unit assemblies are formed by 1 small unit and 3 to 6 small units integrally, there are nineteen sub-combinations in the assembling of each unit assembly which are:

(1) unit assembly formed by three small units:

first unit assembly 1: three small units are vertically and horizontally connected equilaterally as a "L" shape;

second unit assembly 2: three small units are horizontally connected as a "-" shape;

(2) unit assembly formed by four small units:

third unit assembly 3: four small units are vertically and horizontally connected as a "□" shape;

fourth unit assembly 4: four small units are vertically and horizontally connected as a "L" shape;

fifth unit assembly 5: four small units are vertically and horizontally connected as a "⊥" shape;

sixth unit assembly 6: four small units are vertically and horizontally connected as a "⊓" shape;

seventh unit assembly 7: four small units are and horizontally connected as a "—" shape;

(3) unit assembly formed by five small units:

8th unit assembly 8: five small units are vertically and horizontally connected as a "⊿" shape;

9th unit assembly 9: five small units are vertically and horizontally connected as a "+" shape;

10th unit assembly 10: five small units are vertically and horizontally connected as a "ᑭ" shape;

11th unit assembly 11: five small units are vertically and horizontally connected as a "⊥" shape;

12th unit assembly 12: five small units are vertically and horizontally connected as a "⊔" shape;

13th unit assembly 13: five small units are vertically and horizontally connected as a "⊔" shape;

14th unit assembly 14: five small units are vertically and horizontally connected as a "ㄱ" shape;

15th unit assembly 15: five small units are vertically and horizontally connected as a "L" shape;

16th unit assembly 16: five small units are vertically and horizontally connected as a "⊥" shape;

(4) Unit assembly formed by six small units:

17th unit assembly 17: six small units are vertically and horizontally connected as a "⊔" shape;

18th unit assembly 18: six small units are vertically and horizontally connected as a "ㄴ" shape;

(5) Unit assembly formed by one small unit:

19th unit assembly 19: a small unit as "." shape. by the unit assemblies 1~19 to enables with different building block seat, many different large assemblies to be formed.

2. The assembled building blocks as claimed in claim 1, wherein the small unit of the unit assemblies is a polygon, and grooves for receiving the small units are formed on the surface of the building block seat.

* * * * *